US009126228B2

(12) United States Patent
Kuhlenschmidt et al.

(10) Patent No.: US 9,126,228 B2
(45) Date of Patent: Sep. 8, 2015

(54) METHOD FOR ACCELERATED DRYING OF POLYMERS AND DEVICE

(75) Inventors: Birgit Kuhlenschmidt, Hamburg (DE); Daniel Lahidjanian, Hamburg (DE); Dirk Bausen, Harsefeld (DE); Karl Hausmann, Hamburg (DE); Heiko Lassow, Hamburg (DE)

(73) Assignee: Airbus Operations GmbH, Hamburg (DE)

( * ) Notice: Subject to any disclaimer, the term of this patent is extended or adjusted under 35 U.S.C. 154(b) by 1110 days.

(21) Appl. No.: 12/568,184

(22) Filed: Sep. 28, 2009

(65) Prior Publication Data

US 2010/0086669 A1 Apr. 8, 2010

Related U.S. Application Data

(60) Provisional application No. 61/195,429, filed on Oct. 7, 2008.

(51) Int. Cl.
*B05D 3/06* (2006.01)
*B05D 3/02* (2006.01)

(52) U.S. Cl.
CPC ..... *B05D 3/0263* (2013.01); *B05D 3/065* (2013.01); *B05D 2201/00* (2013.01); *B05D 2202/00* (2013.01)

(58) Field of Classification Search
USPC ..... 427/457, 532, 541, 542, 487–522
See application file for complete search history.

(56) References Cited

U.S. PATENT DOCUMENTS

| | | | | |
|---|---|---|---|---|
| 5,387,442 | A * | 2/1995 | Kroeger et al. | 427/521 |
| 6,025,033 | A * | 2/2000 | Herrmann et al. | 427/407.1 |
| 6,231,932 | B1 * | 5/2001 | Emch | 427/542 |
| 6,863,935 | B2 * | 3/2005 | Emch | 427/542 |
| 2004/0099806 | A1 * | 5/2004 | Shelley et al. | 250/339.01 |
| 2006/0127796 | A1 * | 6/2006 | Obata et al. | 430/130 |
| 2006/0222778 | A1 * | 10/2006 | Dixon et al. | 427/542 |
| 2006/0228481 | A1 * | 10/2006 | Gros et al. | 427/299 |

FOREIGN PATENT DOCUMENTS

| | | |
|---|---|---|
| DE | 199 13 446 | 9/2000 |
| DE | 199 15 059 | 10/2000 |

OTHER PUBLICATIONS

Blatter et al., (DE Patent 199 13 446), English Translation pulled from EPO website.*

* cited by examiner

*Primary Examiner* — Humera Sheikh
*Assistant Examiner* — Lucas Wang
(74) *Attorney, Agent, or Firm* — Greer, Burns & Crain Ltd.

(57) ABSTRACT

A method for accelerated drying of at least one polymer which is located at least partially on a component, in particular at least a layer of paint and/or a sealing agent which is applied to an aircraft component in particular with a different material composition, involving the following steps of: a) at least partially applying the at least one polymer, in particular an epoxy resin and/or polyurethane-based layer of paint and/or a sealing agent, to an upper side of the component, and b) at least partially drying the polymer by means of electromagnetic radiation with a wavelength range of between 0.28 μm and 4.0 μm. Accelerated drying of the polymer, in particular the paint layer thereby becomes possible from an upper side of the component to an upper side of the paint layer.

11 Claims, 2 Drawing Sheets

METHOD FOR ACCELERATED DRYING OF POLYMERS AND DEVICE

CROSS REFERENCE TO RELATED APPLICATIONS

This application claims the benefit of U.S. provisional Patent Application No. 61/195,429, filed Oct. 7, 2008, the entire disclosure of which is herein incorporated by reference.

FIELD OF THE INVENTION

The invention relates to a method for accelerated drying of at least one polymer, which is located at least partially on a component, in particular at least a layer of paint and/or a sealing agent which is applied to an aircraft component in particular with a different material composition.

In order to satisfy the increasingly high demands of clients with respect to the colour and appearance of passenger aircraft, the aircraft receive many costly and individually configured coats of paint and inscriptions. Such coats of paint for aircraft are generally carried out with several colours and with complex patterns and structures.

The coats of paint on the aircraft must further withstand increased environmental stresses so that generally only epoxy resin or polyurethane-based paints having at least two components can be used for this application.

The hardening of the finished paint coat is carried out following the painting process in the paint shop at an ambient temperature of approximately 20° C. resulting, in particular in the case of dual-component paints, in very long hardening times.

For single-colour coats of paint, a long hardening time is still acceptable, but the time involved greatly increases with multi-coloured paints since not all the colour shades can be applied at the same time. In order to accelerate the drying processes and reduce the processing times, the ambient temperature in the paint shop is therefore partially raised to a level of up to 35° C. However, this procedure involves significantly increased energy use, with the result that this procedure is normally impractical. Furthermore, this procedure increases the tendency towards the formation of blisters (bubble formation) which leads to unacceptable losses of quality.

Owing to the disadvantages set out above, the methods previously used for producing complex, in particular multi-coloured and multi-layered, paints with short processing times are unsuitable.

SUMMARY OF THE INVENTION

The object of the invention is therefore to set out a method for the accelerated drying of polymers which are at least partially applied to components of passenger aircraft, in particular layers of paint, primers and sealing agents.

This object is achieved for the first time by a method according to patent claim 1 with the following steps of:

a) at least partially applying the at least one polyurethane paint and/or the sealing agent, to an upper side of the component, and b) at least partially drying the polyurethane paint in a drying operation by means of infrared radiation with a wavelength range of between 0.48 μm and 3 μm, wherein the at least one polyurethane paint is hardened from the upper side of the at least one component in such a way that the polyurethane paint is polishable.

Owing to the drying of the polymers which are applied to the component—which are in particular layers of polyurethane paint and/or sealing agents—by means of infrared radiation in a wavelength range of between approximately 0.48 μm and 3 μm, accelerated drying of the coated component is generally possible in less than one hour. The method is preferably used on a layer of paint which is ultimately applied to a component following the final painting operation.

The infrared radiation which acts on the layer of paint is partially reflected, partially absorbed and partially transmitted, the sum of these parts corresponding to the whole of the coupled electromagnetic radiation. The proportion of infrared radiation absorbed in the layer of paint brings about an increase in the kinetic energy of the molecule groups contained in the layer of paint, so that the temperature of the layer of paint increases owing to friction processes at a molecular level.

It is extremely significant that the drying of the layer of paint does not occur from the outer side, but instead the drying begins from the upper side of the component, that is to say, from the inner side of the layer of paint. A very high surface quality of a layer of paint which is dried by means of the method according to the invention is thereby achieved, with hardening times which are at the same time significantly reduced. At the same time, it is possible to harden sealing joints which are formed with a thermally hardenable plastics material or a cross-linkable polymer in an accelerated manner with the layer of paint. The same applies to any sub-coats or "primers" which may have been applied beforehand. Preferably, the method is used with final paint coats. Owing to the use of the method according to the invention, the so-called T-value of the layer of paint improves in particular, which constitutes a measure of the pitting or undularity of the dried layer of paint. The dimensionless T-value is established at two different wavelengths of an electromagnetic measurement radiation and may reach numerical values of between 0 and 24, higher T-values signifying a lower undularity and consequently indicating a higher paint quality. Suitable radiators have been found to be, for example, quartz glass tube radiators with a spiral-wound filament temperature of 2,400 Kelvin at an operating voltage of 235 Volt and a maximum discharged wavelength of 1.2 μm, such a radiator absorbing an electrical power of up to 12 kW. With such a radiator, it is possible to irradiate a surface-area of the layer of paint of, for example, 1.25 m×0.4 m at the same time for accelerated drying and to achieve a sufficiently homogeneous temperature distribution in the region of the layer of paint in this instance.

In a development of the invention, there is provision for a temperature in the region of the at least one polymer to be kept less than or equal to a maximum temperature of 100° C. during the drying operation.

Damage, for example, in the form of undesirable bubble or pitting formation, of the paint layer is thereby prevented, with an optimal drying rate nonetheless being achieved. For example, the paint layer temperature, after passing through a linear heating gradient, is heated to a drying temperature of 80° C. and this is kept constant during the entire drying operation of approximately from 30 to 180 minutes until the subsequent cooling operation. During the cooling operation, the paint layer is cooled to ambient temperature, which can be carried out, for example, with a linear cooling gradient of 20° C./minute. Generally, the cooling operation is already considered to be complete when the component temperature falls below 35° C.

According to another advantageous configuration of the method, the temperature in the region of the at least one polymer is increased during the drying operation from ambient temperature, in particular in a linear manner at a maximum of 20° C./minute, to a drying temperature which is less than or equal to the maximum temperature.

This slow, uniform temperature increase achieves a particularly gentle drying process, so that the same quality of painting results is achieved with the drying method according to the invention as with the long-term passive drying which is conventionally used. In particular, there is a lower level of undularity or pitting of the paint layer, that is to say, the T-value thereof increases.

The temperature increase can be achieved by means of a power adjustment of the radiators using a suitable electronic power system and/or by reducing the spacing between the radiator and the layer of paint. Furthermore, the angle of incidence of the electromagnetic radiation can be varied relative to the component.

In another development of the method, there is provision for the at least one polymer to evaporate before the drying operation in an evaporation operation, in particular over a time period of approximately from 5 minutes to 30 minutes. It is thereby possible for a freshly applied layer of paint to "tighten" to a small degree, whereby the paint is relaxed, the formation of film is optimised and the formation of bubbles is prevented.

Further advantageous configurations of the method are set out in the appended patent claims.

Furthermore, the object of the invention is achieved by a device for carrying out the method, in particular in accordance with patent claims 1 to 9.

Owing to the fact that at least one radiator which emits infrared radiation is provided and emits radiation in a wavelength range of between 0.48 μm and 3 μm, the at least one radiator and the component being able to be positioned relative to each other, accelerated drying which is nonetheless free from losses of quality is ensured for the at least one layer of paint which is applied to the component. It is possible to use, for example, quartz glass tube radiators as radiators. The radiation power transmitted to the paint surface to be dried in the said spectral range changes in accordance with the electrical connection load of the radiators used for testing purposes between approximately 75.1 $W/m^2$ and 159.0 $W/m^2$ with a spacing of 1 m between the radiator and the layer of paint in each case.

In a development of the invention, there is provision for radiation to be applied to a surface-area of the paint layer in a uniform manner using the at least one radiator in such a manner that a substantially uniform temperature distribution is produced in the region of the surface-area.

Uniform hardening is thereby produced over the surface-area of the paint layer applied.

In another advantageous development of the device, there is provision for the at least one radiator to be able to be positioned freely in space relative to the component using a manipulation device and for the manipulation device to be controlled by a control and adjustment device.

Owing to this configuration, the radiator can be automatically positioned over the at least one paint layer and, after reaching a predetermined degree of drying, can be guided over the remainder of the component on predefined trajectories in order to completely dry the entire paint layer. The trajectories may extend in such a manner that the surfaces which are scanned afterwards by the radiator at least partially overlap in edge regions in which the surfaces adjoin each other. This procedure is in particular advantageous when the painted components have large dimensions, such as, for example, complete aircraft fuselages, rudder units or complete wings.

However, if the dimensions of the painted components are smaller, it may be advantageous to position the component itself relative to the radiator. For example, a painted rudder unit can be guided through a portal-like arrangement of radiators using a suitable manipulation device, such as, for example, a conveyor belt, with a suitable advance speed. However, components with very small dimensions can be introduced completely into a drying arrangement with a plurality of radiators which are arranged on all sides in a matrix-like manner, so that positioning of the component in relation to the radiators is no longer required and very rapid, parallel drying of the layers of paint applied to the component is possible.

Further advantageous configurations of the device are set out in the appended patent claims.

DETAILED DESCRIPTION OF THE DRAWINGS

Figure 1:
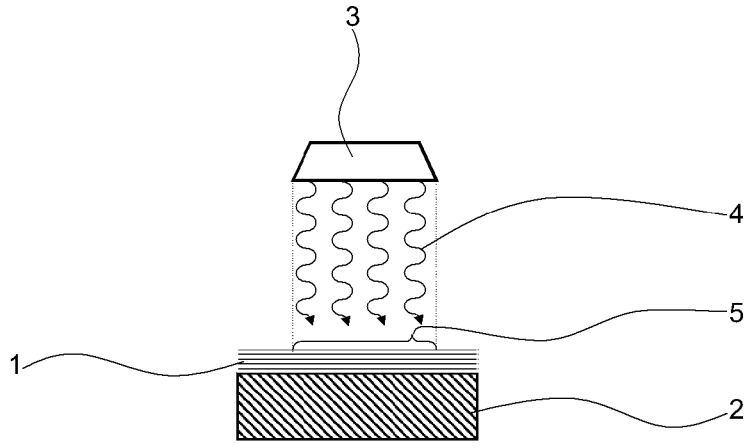
FIG. 1 is a schematic illustration of a device for carrying out the method.

In the drawings, the same structural features have the same reference numerals.

FIG. 1 is a schematic illustration of a device for carrying out the method.

A layer of paint 1 is applied to a component 2. The layer of paint 1 was a highly resilient polyurethane paint (PUR) with the reference "CA 8000" from the manufacturer PPG®. This paint contains a base, a hardener and a thinning agent. Using the thinning agent, it is possible to vary in particular the reaction speed of the paint layer 1. Using a radiator 3, which emits electromagnetic radiation 4 at high intensity, a surface-area 5 of the paint layer 1 is rapidly dried in a selective manner. The surface-area 5 is 0.5 $m^2$, but can be increased to several square meters in order to harden large components. Approximately 85% of the electromagnetic radiation energy emitted by the radiator 3 is in a wavelength range of between 0.48 μm and 3.0 μm (so-called IR-A and IR-B). The power applied per surface-area is in the said wavelength range of between 75.1 $W/m^2$ and 83.9 $W/m^2$ at a preferred spacing of between 60 cm and 80 cm between the layer of paint 1 and the radiator 3. For the first time, the parameters mentioned allow, for example, accelerated drying of the paint layer 1 of the component 2 in the form of a rudder unit of an aircraft in a single drying operation, although the rudder unit is formed from a material mixture comprising carbon-fibre and glass-fibre-reinforced thermosetting plastics and aluminium and optionally titanium alloys. The different materials are provided with different primers and sub-coatings which generally have different colours and different technical functions. For example, a top coat is grey for a rudder unit which is produced with an aluminium alloy, whereas an erosion protection paint is white and an anti-static paint for composite materials is black. Further optional primers are beige. For the first time, the method allows—regardless of the different absorption and reflection properties owing to the partially different colouring of the component—simultaneous drying of a finally applied final paint layer with a nonetheless uniform drying process of the final paint layer on all bases.

Figure 2:
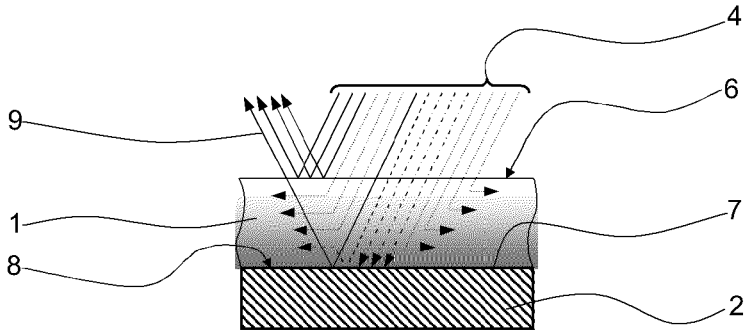
FIG. 2 is a schematic illustration of the operating method of the infrared paint drying.

FIG. 2 illustrates the basic operating mechanism of the method. The paint layer 1 which is applied to the component 2 or the substrate is irradiated by a radiator 3, in particular a high-energy IR radiator with electromagnetic radiation 4 of high energy density. The radiation portions which are illustrated with dotted lines are each absorbed directly in the paint layer 1, whereby the kinetic energy of the molecule groups is increased and consequently the temperature in the paint layer 1 increases. However, the radiation portions which are illustrated with solid lines are reflected directly by an upper side 6 of the paint layer 1 and can consequently make no active contribution to the temperature increase of the paint layer 1. The radiation portions which are indicated with dot-dash lines are in contrast absorbed in a boundary region 7 between the paint layer 1 and the component 2 and in the region of an upper side 8 of the component 2, that is to say, this radiation portion is substantially transmitted by the paint layer. Although a further radiation portion which is illustrated with a dashed line is reflected back in the boundary region 7 and from the upper side 8 of the component 2 into the paint layer 1, it is then absorbed in the paint layer 1 above. Another radiation portion 9 is completely reflected in the boundary region 7 but not absorbed by the paint layer 1 and is discharged, without making any active contribution to the thermal heating of the paint layer 1, in the region of the upper side 6 of the paint layer 1.

Of decisive significance for the method according to the invention in this context is that the drying of the paint layer occurs from the upper side 8 of the component 2 and then extends as the drying process continues in the direction of the upper side 6 of the paint layer 1. In particular in the case of curved paint layers, a transposed drying process, that is to say, a drying process which would extend from the upper side 6 of the paint layer 1 in the direction of the upper side 8 of the component 2, would lead to quality losses, in particular to the formation of folds in the hardened paint layer 1, since the shrinking of the paint layer 1 caused by hardening leads to slight occurrences of buckling owing to the different radii in the case of curved components 2 in the region of the upper side of the paint layer and the upper side of the component.

Figure 3:
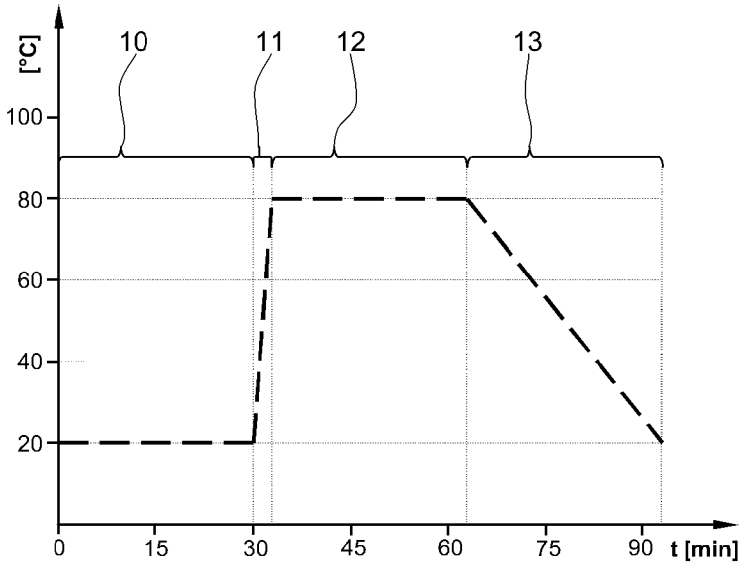
FIG. 3 is a graph of the temperature gradient when carrying out the method.

FIG. 3 illustrates the temperature gradient within the paint layer during the process.

First, the paint layer 1 is applied to the component 2 using known technologies. This process is completed at the time t=0 minutes. An evaporation operation 10 of the paint layer 1 follows, in which the slightly volatile matter is discharged from the paint layer 1 and the paint layer "tightens" and the mechanical resistance thereof increases slightly. The evaporation operation 10 is carried out at ambient temperature, that is to say, generally at 20° C. In addition, flow processes within the paint layer 1 are still possible to a small degree in the evaporation operation 10, so that partially different paint densities owing to flow processes caused by gravitational force can still independently compensate for each other to some degree and the quality of the painting increases. Furthermore, the paint layer 1, after the evaporation operation 10 is carried out, is less susceptible, owing to the mechanical resistance thereof which is then slightly increased, to particles of dirt which otherwise penetrate the paint layer 1 very easily and significantly impair the surface quality. The duration of the evaporation operation 10, depending on the paint system used and the ambient temperature, is between 5 and 30 minutes.

A heating operation 11 follows the evaporation operation 10. During the heating operation 11, the temperature in the region of the paint layer 1 is preferably brought to a drying temperature of approximately 80° C. The temperature increase extends in the form of a linear ramp function with a positive gradient which is approximately 20° C./minute. After reaching the drying temperature of 80° C., in a subsequent drying operation 12 this temperature level is kept as constant as possible for the entire duration of the drying operation 12. The duration of the drying operation 12 involves a time period of between 15 minutes and 60 minutes, but preferably 30 minutes. A cooling operation 13 follows the drying operation 12. In the embodiment illustrated in FIG. 3, the layer of paint 1 is cooled with a linear ramp function in 30 minutes to ambient temperature which is assumed to be 20° C., which corresponds to a negative gradient of approximately 2° C./minute. The defined cooling of the paint layer 1 is optionally carried out using a cooling device which is not illustrated, for example, a cool air fan. After the cooling operation 13 is complete, the actual painting process is complete and the paint layer 1 has almost reached its final level of mechanical resistance.

In order to further improve the surface quality of the rapidly dried paint layer 1, further method steps may follow the cooling operation 13. For example, it is possible to subject the paint layer 1 to a surface refinement by means of known polishing processes. The improvement of the surface geometry of the paint layer 1 results in this instance from combined compression and smoothing effects brought about by the polishing in the region of the upper side 6 of the paint layer 1. The surface refinement in the form of the subsequent surface polishing is enabled only by the complete drying or hardening of the paint layer 1 which is preferably formed with a highly resilient polyurethane paint in accordance with the accelerated drying method according to the invention.

In the embodiment illustrated according to FIG. 3, the complete drying process requires approximately only 93 minutes and consequently, in comparison with drying processes which are carried out at the normal ambient temperature of 20° C., is significantly faster and can be more readily automated. Furthermore, the drying results can be better reproduced since fluctuation influences of the ambient atmosphere have only a small influence.

Figure 4:
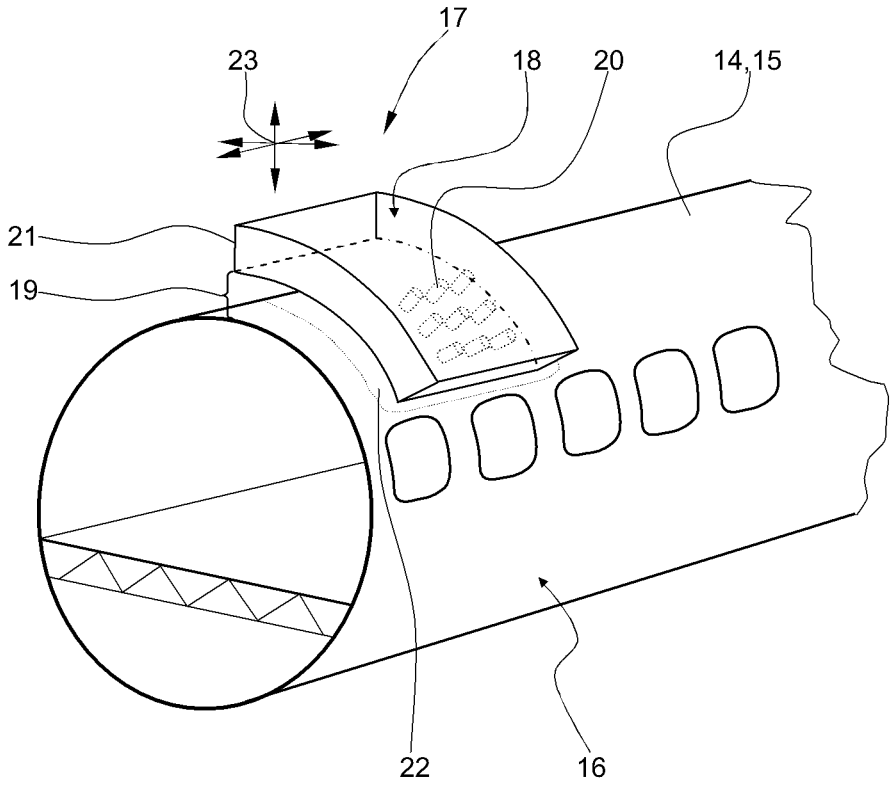
FIG. 4 is a schematic variant of the device for accelerated drying of a layer of paint on a large component.

The perspective drawing in FIG. 4 illustrates a device for preferably fully-automated implementation of the method according to the invention on large components.

A large component 14 which, in the embodiment illustrated, is an only partially illustrated fuselage 15 of an aircraft has been provided with a layer of paint 16.

In order to dry the paint layer 16, a device 17 has a radiator 18 which is positioned and guided with a spacing 19 preferably of between 60 cm and 80 cm above the paint layer 16 by means of a manipulation device which is not illustrated. The manipulation device is, for example, a standard articulated arm robot which has at least six degrees of freedom and which is controlled by a control and adjustment device which is also not illustrated. Alternatively, portal robots can also be considered for positioning the radiator 18, the portal being configured as a circular segment or a closed circle so that the radiator 18 can pass around the fuselage 15 with spacing 19. The radiator 18 is constructed with a plurality of individual radiators which are arranged in matrix-like form, of which only one individual radiator 20 is provided with a reference numeral. The individual radiators 20 are each formed with quartz glass tube radiators which are not illustrated in greater detail. The arrangement of the individual radiators 20 is preferably adapted to a surface geometry of the component 14 or the fuselage 15 illustrated. In the illustrated embodiment of FIG. 4, the individual radiators 20 are spatially arranged substantially in the form of a cylinder-surface-like portion.

Furthermore, the radiator 18 has a reflector 21 which serves to homogenise the electromagnetic radiation emitted by the individual radiators 20. Owing to the plurality of individual radiators 20 which are arranged in the form of a matrix, a large surface-area 22 of the paint layer 16 can be dried at the same time. The surface-area 22 may extend over several square meters. The individual radiators 20 are controlled by an electronic power system which is not illustrated and which allows stepless adjustment of the power of the electromagnetic radiation transmitted by the radiator 18 to the paint layer 16 with the control and adjustment device. Owing to the individual control of the individual radiators 20, together with an optionally complex surface geometry of the reflector 21 which is differently curved twice in regions, an extensive homogenisation of the radiation field emitted by the radiator 18 is possible so that the drying rate of the paint layer 16 is substantially constant over the entire surface-area 22.

In the control and adjustment device there may be further integrated a measuring device, by means of which the current drying level of the paint layer 16 obtained can be measured directly so that the duration of the drying operation 12 changes. Optimal drying results can thereby be obtained, regardless of the ambient climatic conditions and/or the painting system used. Such a measurement of the currently obtained drying level of the paint layer 16 can be achieved, for example, by means of a diffuse reflection measurement in the near infrared range since these reflection values measurably change in accordance with the level of cross-linking obtained at each stage and consequently the level of drying of the paint layer 16.

Alternatively, the control and adjustment device may also be provided with only a time measuring device (so-called "timer"). In the case of pure time control, however, a manual adaptation of the duration of the drying operation 12 to different painting systems is required. The manipulation device which is not illustrated allows the component 14 to be moved in a fully automated manner with the radiator 18 with precisely defined spacing 19 on precisely determined movement paths and consequently allows the device to be integrated in a fully automated painting unit. A movement of the radiator 18 is possible in the direction of the three black double-headed arrows 23 relative to the component 14. Conversely, the component 14 can also be positioned freely in space relative to a radiator 18 which is then constructed in a stationary manner in order to achieve uniform surface drying of the paint layer 16. Which positioning is preferred in the individual case is dependent in particular on the geometric dimensions of the component 14, that is to say, in particular the size thereof.

The method according to the invention and the associated device are suitable for drying a plurality of polymers, in particular epoxy paints, polyurethane paints and acrylic paints on a large range of different bases. The method can be used with both metal bases and plastics-based bases, such as, for example, carbon-fibre or glass-fibre-reinforced plastics materials.

LIST OF REFERENCE NUMERALS

1 Paint layer
2 Component
3 Radiator
4 Electromagnetic radiation
5 Surface-area
6 Upper side (paint layer)
7 Boundary region (between component and paint layer)
8 Upper side (component)
9 Radiation portion
10 Evaporation operation
11 Heating operation
12 Drying operation
13 Cooling operation
14 Component
15 Fuselage
16 Paint layer
17 Device
18 Radiator
19 Spacing
20 Individual radiator
21 Reflector
22 Surface-area
23 Double-headed arrow

The invention claimed is:

1. A method for accelerated drying of at least one polyurethane paint which is located at least partially on an aircraft component formed from a material mixture comprising different absorption and reflection properties, comprising the steps of:

a) at least partially applying the at least one polyurethane paint, to an upper side of the aircraft component formed from the material mixture comprising different absorption and reflection properties, wherein the polyurethane paint is a three component paint which contains a base as a first component, a hardener as a second component and a thinning agent as a third component, and b) at least partially drying the polyurethane paint in a drying operation by means of infrared radiation with a wavelength range of between 1550 nm and 3000 nm, wherein the at least one polyurethane paint is hardened from the upper side of the at least one component in such a way that the polyurethane paint is polishable, wherein the power applied per surface-area by a radiator is in a range of between 75.1 $W/m^2$ to 159.0 $W/m^2$ and wherein a spacing between the polyurethane layer of paint and the radiator is between 60 cm to 100 cm.

2. The method according to claim 1, wherein a temperature in the region of the at least one polyurethane paint is kept less than or equal to a maximum temperature of 100° C. during the drying operation.

3. The method according to claim 1, wherein the temperature in the region of the at least one polyurethane paint is increased during the drying operation from ambient temperature in a linear manner at a maximum of 20° C./minute, to a drying temperature which is less than or equal to the maximum temperature.

4. The method according to claim 1, wherein the at least one polyurethane paint evaporates before the drying operation in an evaporation operation over a time period of approximately from 5 minutes to 30 minutes.

5. The method according to claim 1, wherein the drying operation is ended in a time-controlled manner.

6. The method according to claim 1, wherein a drying level of the at least one polyurethane paint is established by means of at least one measuring device.

7. The method according to claim 1, wherein, after reaching a predetermined drying level of the at least one polyurethane paint, the polyurethane paint is cooled in a cooling operation for at least 30 minutes to ambient temperature.

8. The method according to claim 1, wherein, after the drying operation is complete, or after the cooling operation has ended, a mechanical surface refinement is carried out in order to increase a T-value of the at least one polyurethane paint, wherein the T-value is a dimensionless value and is established at two different wavelengths of an electromagnetic measurement radiation.

9. The method according to claim 8, wherein the surface refinement is carried out by means of polishing, wherein the polishing brings about a compression and smoothing effect.

10. The method according to claim 1, wherein in step a) an additional sealing agent is applied on the upper side of the aircraft component.

11. The method according to claim 1, wherein in step b) the power applied per surface-area is in a range of between 75.1 $W/m^2$ to 83.9 $W/m^2$.

* * * * *